United States Patent [19]

Simpson

[11] 4,274,170

[45] Jun. 23, 1981

[54] COLLAPSIBLE KAYAK

[76] Inventor: Douglass E. Simpson, 2 - 3443 West 2nd Ave., Vancouver, British Columbia, Canada, V6R 1J3

[21] Appl. No.: 937,540

[22] Filed: Aug. 28, 1978

[51] Int. Cl.[3] ..... B63B 37/72; B63B 7/04

[52] U.S. Cl. ..... 9/1.4; 9/2 C; 9/2 F

[58] Field of Search ..... 9/2 R, 2 F, 2 C, 1.4, 9/1.5, 6.5; 135/15 PQ

[56] References Cited

U.S. PATENT DOCUMENTS

| | | | |
|---|---|---|---|
| 247,827 | 10/1881 | Hunt | 9/2 R |
| 1,093,357 | 4/1914 | Sanders | 9/2 C |
| 2,705,015 | 3/1955 | Langlais | 135/15 PQ |
| 2,994,891 | 8/1961 | Przybylski | 9/2 C |
| 3,028,612 | 4/1962 | Sindell | 9/2 C |
| 3,123,840 | 3/1964 | Cefalo | 9/2 C |
| 3,123,841 | 3/1964 | Bronner | 9/2 C |
| 3,383,719 | 5/1968 | Van Der Heide | 9/2 C |
| 3,869,743 | 3/1975 | Brown | 9/2 C |
| 4,124,910 | 11/1978 | Raymond | 9/2 F |

*Primary Examiner*—Edward R. Kazenske
*Attorney, Agent, or Firm*—Carver and Company

[57] ABSTRACT

Collapsible kayak framework having a plurality of longitudinal members, formers and cockpit structure, which cockpit structure, when folded forms a portion of backpack frame. Longitudinal members extend between the bow and stern, and are releasably interconnected by the formers and the cockpit structure. Mid portions of the keelson, chine and gunwale member portions are interconnected so as to form two halves of a foldable cockpit structure, which halves are maintained apart when in the cockpit structure by releasable transverse deck members. The mid portions are hinged to each other for swinging together to form a compact frame forming basis of the backpack frame. When the structure is folded, the spaced transverse deck members extend downwardly from one gunwale member mid portion, lower ends of the deck members carrying ends of shoulder straps, and a belt portion to permit the complete folded kayak structure to be carried on a person's back.

16 Claims, 16 Drawing Figures

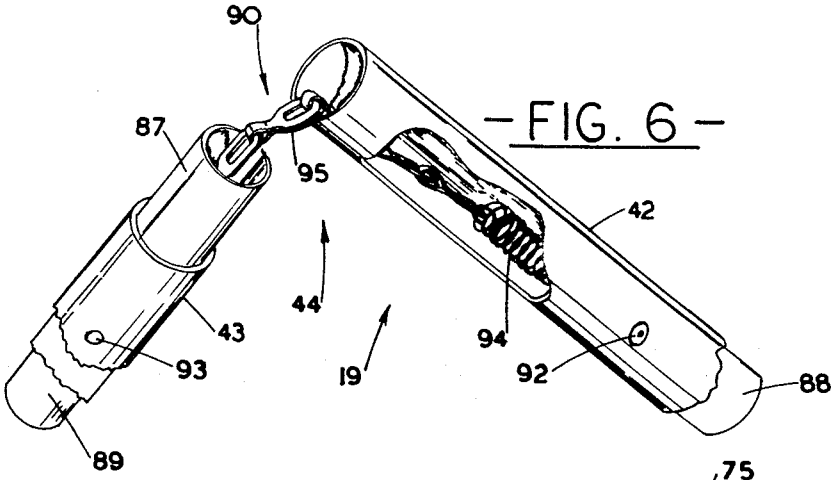
-FIG. 6-
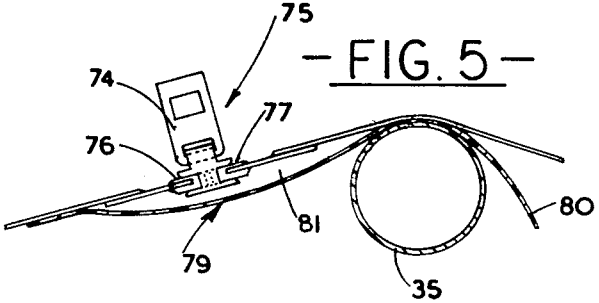
-FIG. 5-
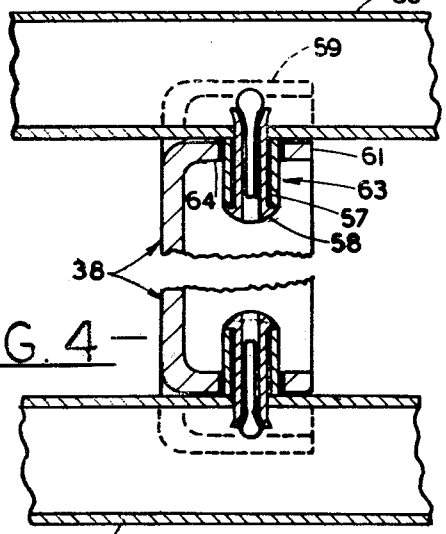
-FIG. 4-
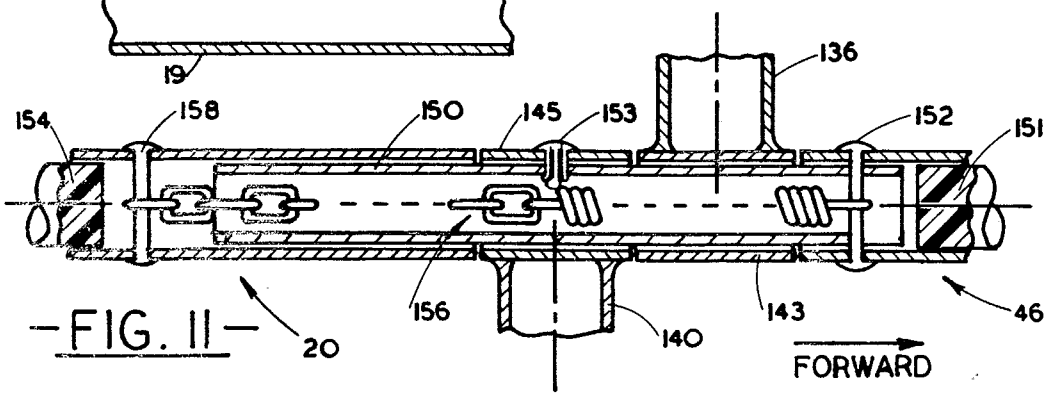
-FIG. 11-

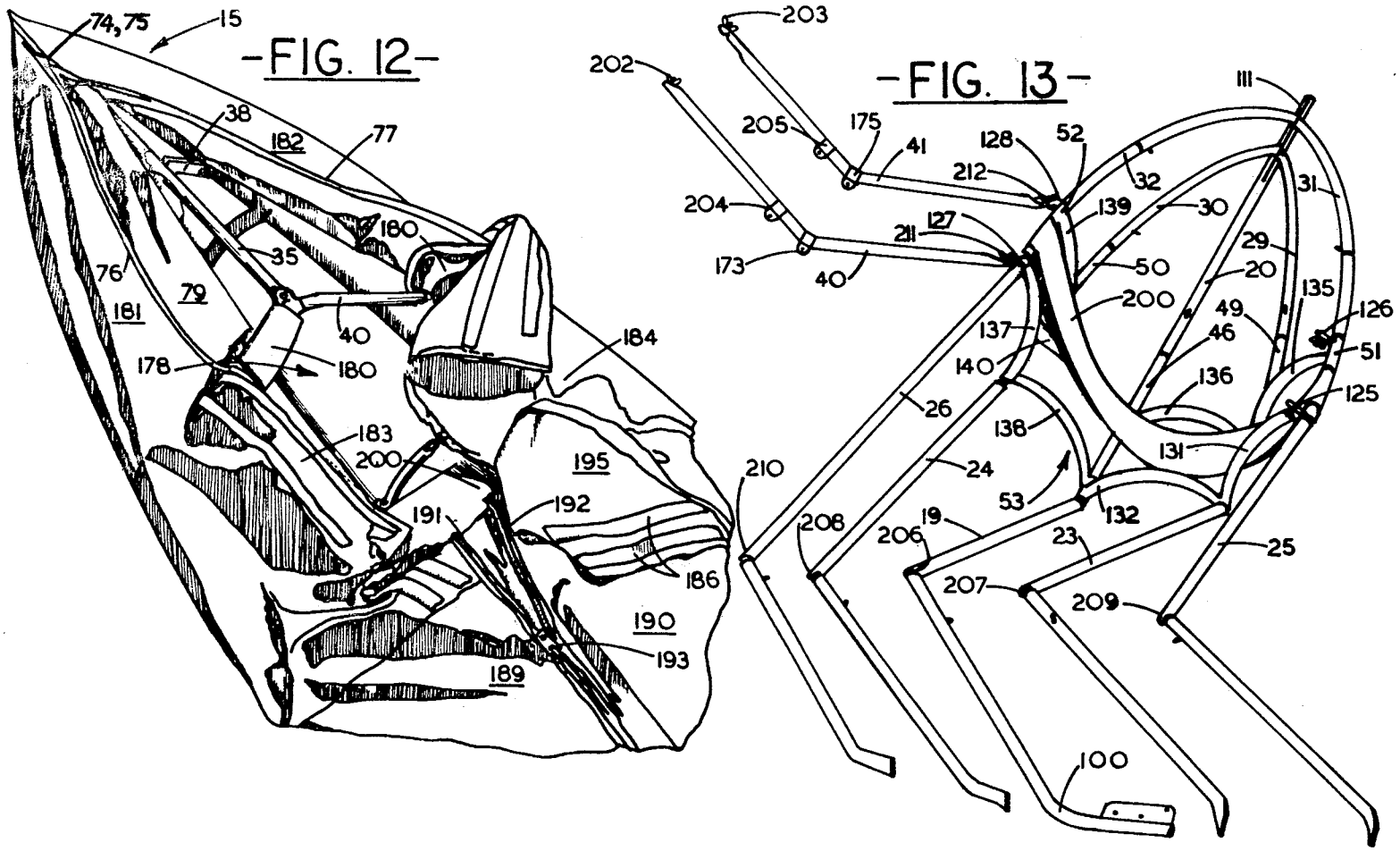
-FIG. 13-
-FIG. 12-

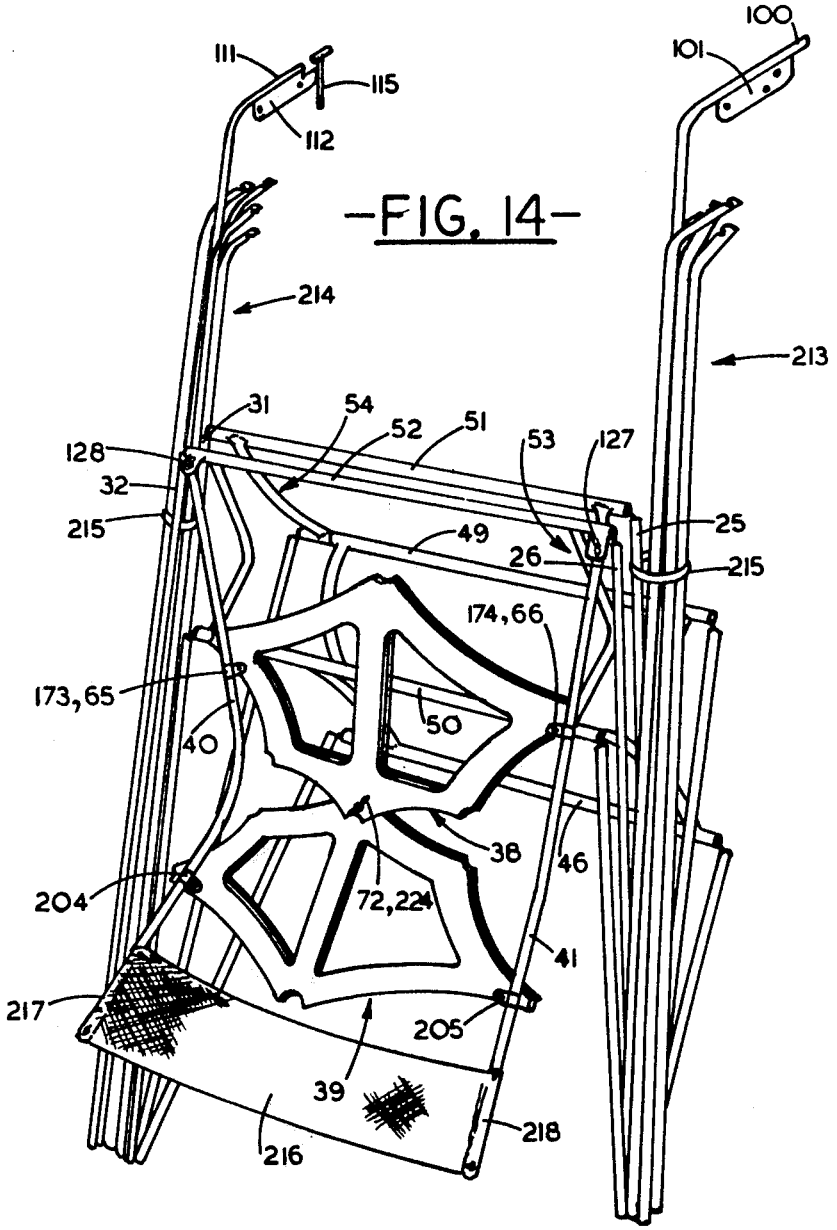
-FIG. 14-

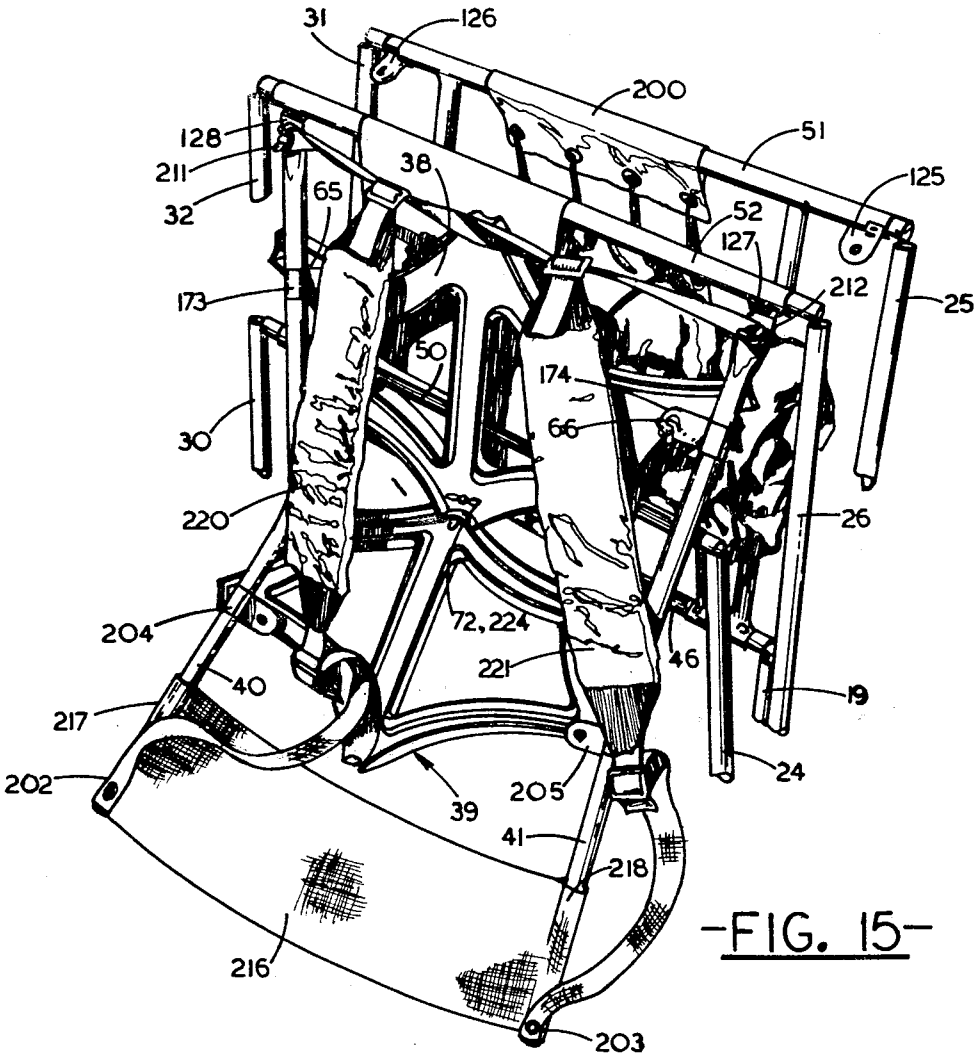
-FIG. 15-

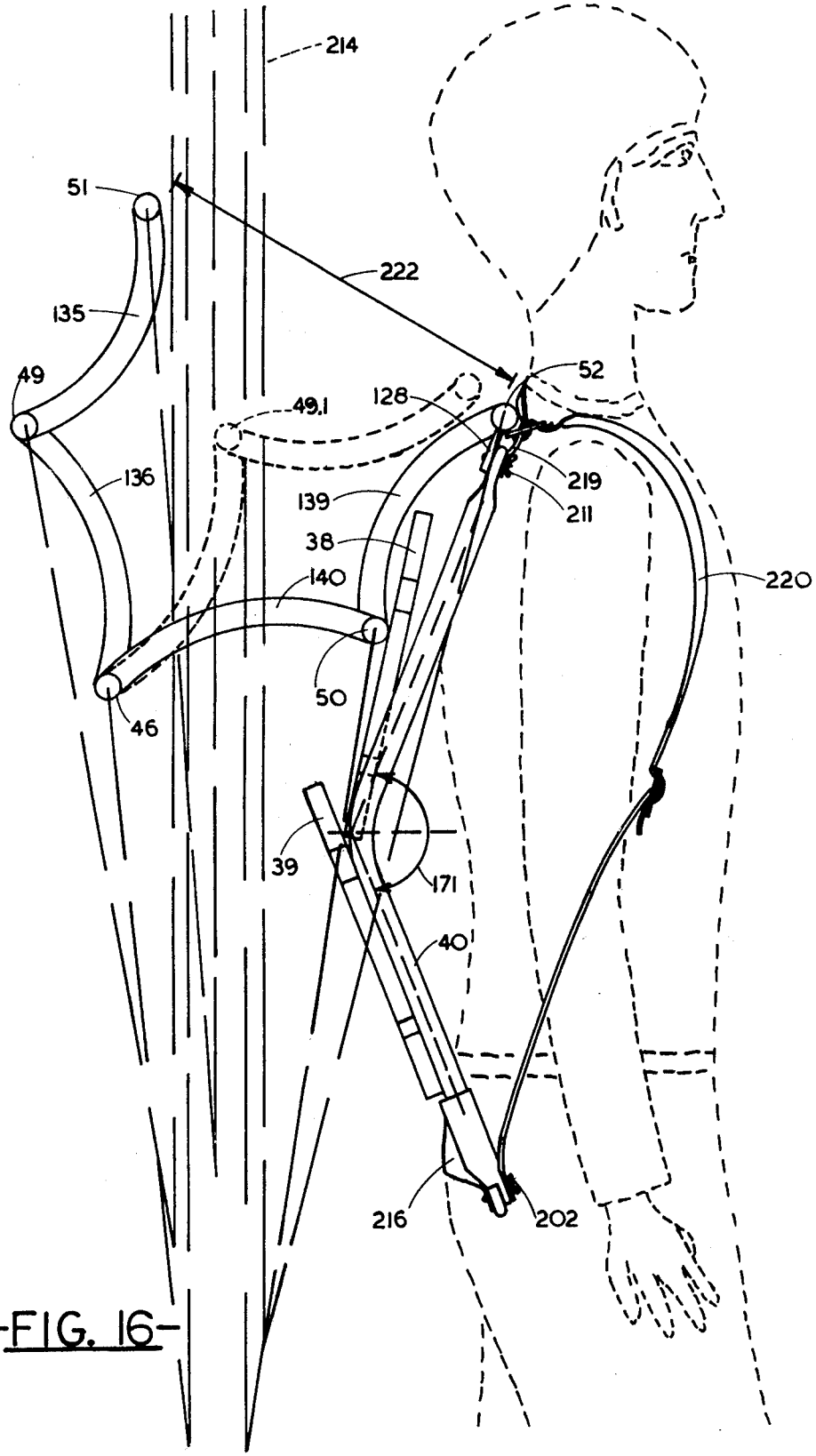
-FIG. 16-

COLLAPSIBLE KAYAK

BACKGROUND OF THE INVENTION

1. Field of the Invention

The invention relates to a collapsible kayak, in particular a kayak which, when collapsed, can be easily converted into a structure resembling a backpack frame for carrying on a person's back.

2. Prior Art

Collapsible kayaks are well known and several designs have been commercially available for many years. Some of the better known types are assembled from a plurality of disconnected stringers and formers which are joined together with latches and clamps to form a relatively loose framework, in which bow and stern halves are temporarily hinged together amidships. The skin is usually a one piece skin having bow and stern-shaped pockets and a central upper opening adjacent the cockpit structure. The opening receives the two halves of the framework, sometimes separately, which halves are then rigidly connected together inside the skin. In some designs an over-centering means or an equivalent stretches the skin to form a relatively taut skin around the framework. Commonly the skin is strained somewhat to provide a reaction to force on the framework and thus is an integral structural part of the kayak, that is, without the skin the kayak frame has insufficient rigidity.

Such designs of kayak when disassembled result in a large number of disconnected pieces and require a considerable time to re-assemble, and require skill and care in following the instructions. It is not unusual to accidently loose an important piece when disassembled. If the boat is to be transported in its collapsed state at least two bags are required, one of the bags containing the stringers, formers, fasteners, etc. of the framework, and the other bag containing the skin. Whilst such a kayak has the advantage of being collapsible for fitting in a confined space, for example into an aircraft flying into the wilderness, these structures are usually not designed primarily for easy carrying on a person's back.

SUMMARY OF THE INVENTION

The present invention reduces some of the difficulties and disadvantages of the prior art by providing a collapsible kayak in which disassembled component parts thereof are relatively few, and elongated members of the framework can be simply connected together by elastic links which facilitates assembly, reduces time required for assembly, and also reduces chances of loss of pieces. Furthermore, the structure can be assembled with little skill and the framework without the skin, ie. by itself, has adequate rigidity for normal forces and thus the skin is not loaded excessively by framework forces. Furthermore, the structure, when disassembled, forms a relatively convenient backpack frame for carrying on a person's back and simultaneously permits carrying on the backpack frame the remaining disassembled structure of the kayak as well as other gear.

A collapsible kayak according to the invention has a framework characterized by a plurality of longitudinal members including forward and aft keelson member portions, forward and aft port and starboard chine and gunwale member portions, and forward and aft longitudinal deck members. The framework includes formers and a cockpit structure, the longitudinal members releasably interconnecting the cockpit structure with the bow and stern of the kayak. The cockpit structure includes a keelson member mid portion, port and starboard chine member mid portions spaced on opposite sides of the keelson mid portion, and port and starboard gunwale member mid portions spaced above the chine member mid portions. The mid portions interconnect longitudinally the respective forward and aft longitudinal members. The cockpit structure also includes forward and aft interconnecting members interconnecting adjacent mid portions so as to form a frame of generally parallel mid portions. Each interconnecting member has a respective port and starboard portion which is connected rigidly to the respective port and starboard chine and gunwale member mid portions to form rigid port and starboard cockpit frame halves. Forward and aft transverse deck members are adapted to extend between the gunwale member mid portions. The port and starboard cockpit frame halves are hinged relative to each other adjacent the keelson member mid portion for swinging thereabouts. This effectively permits the cockpit structure to be folded about the keelson member mid portion to permit the port and starboard mid portions to approach each other. The transverse deck members and the gunwale member mid portions define a cockpit opening to receive a person. Each transverse deck member has at least one end releasably connected adjacent opposite ends of one of the gunwale member mid portions, the forward and aft longitudinal deck members being releasably connected adjacent the forward and aft transverse deck members. When the framework is assembled, the forward and aft keelson, chine and gunwale member portions are connected to the respective keelson, chine and gunwale member mid portions of the cockpit structure to form a generally smoothly curved framework. In one embodiment, when disassembled the kayak structure forms a backpack frame. In this embodiment, the cockpit structure is foldable about an axis parallel to the mid portions thereof so as to bring the mid portions closer together.

The invention is also characterized by a method of folding a kayak as above described into a framework suitable for use as a backpack frame. The method is characterized by removing the kayak framework from the skin, and removing the formers and disconnecting the longitudinal members from each other, from the transverse deck members and from the mid portions of the cockpit structure. The cockpit structure is then folded about the keelson member mid portion to bring the mid chine and gunwale member portions thereof closer together and the longitudinal members are secured for carrying. The transverse deck members are positioned to extend from one side of the cockpit structure generally parallel to each other and a band is connected to extend between the transverse members to engage a person's torso and the deck members are maintained apart to maintain the band taut. A pair of shoulder straps are connected to positions adjacent upper and lower ends of the transverse deck members so as to form two loops to engage a person's shoulders so as to resemble a backpack frame structure in which the mid portions of the cockpit structure extend generally normally to the transverse deck members and are disposed on a side of the transverse deck members remote from the person's back. The longitudinal members can be carried in convenient bundles as required. In the preferred method, after the cockpit structure is folded to bring the mid portions closer together, the method is characterized by gathering the longitudinal members extending from the cockpit structure to the bow into a first bundle, and gathering the longitudinal members extending from the cockpit structure to the stern into a second bundle. The bundles are then secured adjacent ends of mid portions of the folded cockpit structure so that the cockpit structure is sandwiched between the bundles.

A detailed disclosure following, related to the drawings, describes a preferred apparatus and method according to the invention which are capable of expression in structure and method other than those particularly described and illustrated.

DESCRIPTION OF THE DRAWINGS

FIG. 4 is a simplified fragmented section on line 4—4 of FIG. 2, showing releasable connections between the former and two longitudinal members, FIG. 5 is a simplified fragmented detailed section showing skin fastening means, FIG. 6 is a simplified fragmented section showing one example of connecting links between adjacent longitudinal members, FIG. 12 is a simplified fragmented perspective showing forward portions of the kayak framework partially installed in the skin, FIG. 13 is a simplified perspective of portions of the framework of the kayak, some portions being removed therefrom prior to folding, the forward portions being shown partially collapsed, FIG. 14 is a simplified fragmented perspective of the kayak framework converted to a backpack frame structure, some portions omitted for clarity, FIG. 15 is a simplified fragmented perspective showing portion of the framework in the backpack frame configuration, some portions omitted for clarity, FIG. 16 is a simplified side elevation showing portions of the kayak structure folded into the backpack frame configuration, some portions being omitted or shown diagrammatically for clarity.

DETAILED DISCLOSURE

FIGS. 1 through 4

Figure 1:
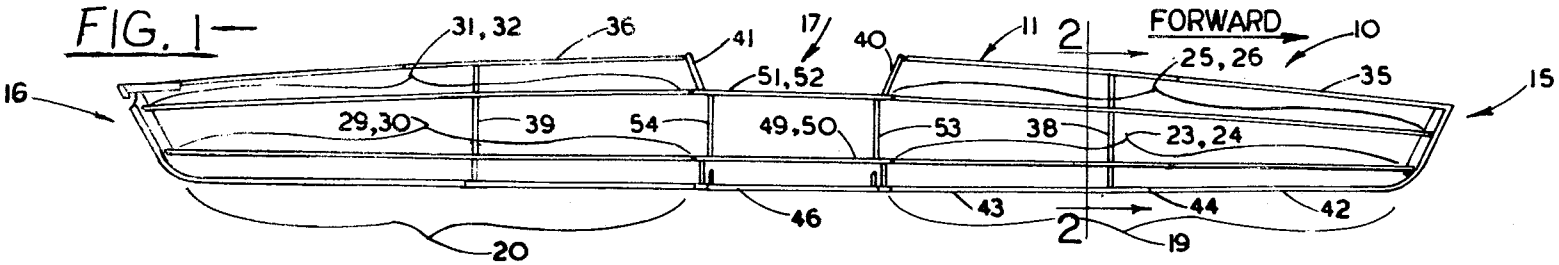
FIG. 1 is a simplified side elevation of a kayak framework according to the invention with the kayak skin removed.
Figure 2:
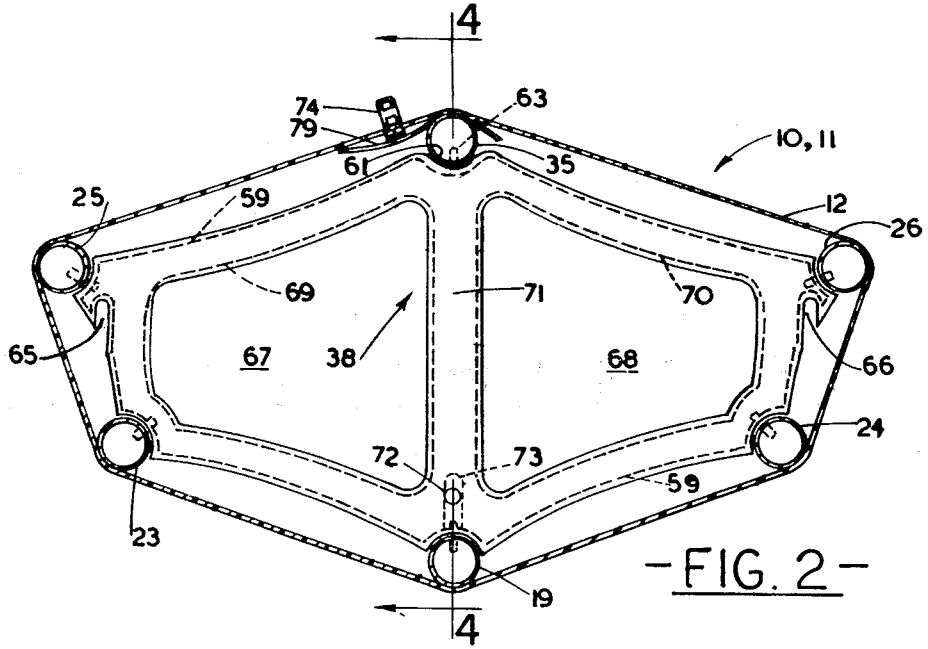
FIG. 2 is a simplified transverse section on line 2—2 of FIG. 1 showing a forward former and longitudinal members, the skin being fitted.
Figure 3:
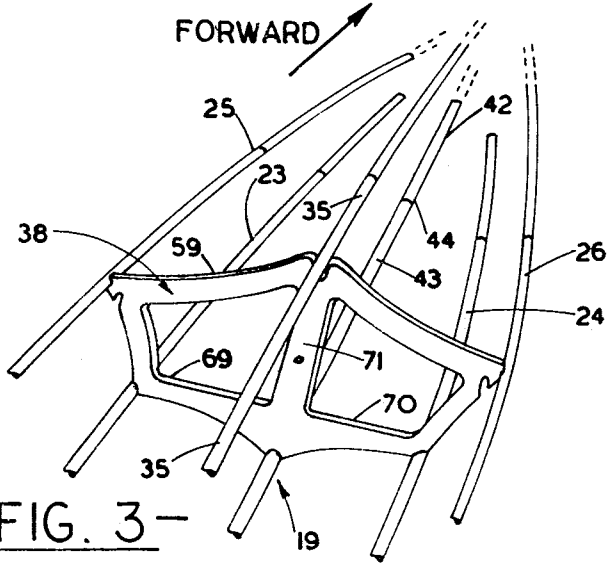
FIG. 3 is a fragmented perspective of the former of FIG. 2 and portions of the longitudinal members with the skin removed.

Referring to FIGS. 1 through 3, a kayak 10 according to the invention has a framework 11 covered by a flexible water impermeable skin 12, the skin being generally complementary to the framework and being shown only in FIG. 2. The kayak 10 has a bow and stern 15 and 16 respectively and a cockpit structure 17 to receive a kayakist, not shown. The framework includes a plurality of longitudinal members including forward and aft keelson member portions 19 and 20, port and starboard forward chine member portions 23 and 24, and port and starboard forward gunwale member portions 25 and 26. The structure includes port and starboard aft chine member portions 29 and 30, and port and starboard aft gunwale member portions 31 and 32. The aft port chine member portion 29 and aft port gunwale member portion 31 are shown only in FIG. 13 and are similar to the forward port chine member portion 23 and forward port gunwale member portion 25, as best seen in FIG. 3. The longitudinal members also include forward and aft longitudinal deck members 35 and 36, and the framework includes forward and aft formers 38 and 39 which releasably interconnect the longitudinal members, as will be described. Forward and aft transverse deck members 40 and 41 define forward and aft edges of the cockpit structure. The cockpit structure 17 is described in greater detail with reference to FIGS. 9 and 10, the cockpit structure connecting the longitudinal and deck members together to form the kayak, as will be described.

All the longitudinal members, that is the keelson member portions 19 and 20, the chine member portions 23, 24, 29 and 30, the gunwale member portions 25, 26, 31 and 32 and the deck members 35 and 36 are tube assemblies, preferably of an aluminum alloy having high strength and corrosion resistance. The tube assemblies preferably can be divided into at least two tubular sections to facilitate folding of the kayak, two such tubular sections 42 and 43 being shown for the forward keelson portion 19. The sections are aligned with each other and connected by a joint 44, which joint is described in greater detail with reference to FIG. 6, the joint being positioned at a location on the keelson member portion convenient for folding the longitudinal members into bundles, as will be described. Undesignated joints on the remaining longitudinal members are shown and it is seen that these occur in different locations longitudinally of the kayak convenient for folding of the particular longitudinal member into at least two approximately equal lengths. The joints are positioned remotely from the formers for simplicity.

As will be described in greater detail with reference to FIGS. 9 and 10, the cockpit structure 17 further includes a keelson member mid portion 46 releasably connected to and aligned with the forward and aft keelson member portions 19 and 20, port and starboard chine member mid portions 49 and 50 releasably interconnected to and aligned with the forward port and starboard chine member portions 23 and 24 and the aft chine member portion 29 and 30 respectively. The cockpit structure also includes port and starboard gunwale member mid portions 51 and 52 releasably connected to and aligned with the port and starboard forward gunwale member portions 25 and 26 and the aft gunwale member portions 31 and 32 respectively. The mid portions of the cockpit structure are similarly tubular and are connected to the forward and aft longitudinal member portions similarly to the joint 44 so that the longitudinal members of the kayak have aligned complementary sections which extend smoothly from the bow 15 to the stern 16. The joints between all sections have essentially flush outer walls so as to reduce risk of damage to the skin.

The structure 17 further includes forward and aft interconnecting members 53 and 54 interconnecting adjacent member mid portion so as to form a frame of generally parallel mid portions in which the port and starboard gunwale member mid portions are spaced above the chine member mid portions, the four mid portions being spaced laterally from the keelson mid portion. The cockpit structure 17 thus has a frame which includes the forward and aft transverse deck members 40 and 41 which extend between the gunwale member mid portions 51 and 52 to define a cockpit opening to receive a kayakist, not shown. As will be described with reference to FIGS. 9 and 10, each transverse deck member has at least one end releasably connected to the opposite side of the cockpit opening, and the forward and aft longitudinal deck members 35 and 36 are releasably connected to the forward and aft transverse deck members 40 and 41 respectively. It can be seen that when the framework 11 is assembled, the forward and aft keelson, chine and gunwale member portions are connected to the respective keelson, chine and gunwale member mid portions of the cockpit structure to form a generally smoothly curved framework.

Referring to FIGS. 2 through 4, the forward former 38 is preferably formed from sheet metal and has an outer flange 59 extending peripherally therearound to stiffen the former and to facilitate connections with the longitudinal members. The flange 59 has six partially cylindrical recesses or seats to accept the longitudinal members therein, a typical recess or seat 61 to receive the forward longitudinal deck member 35 being described as follows. The recess 61 of the flange is formed so as to be complementary to an inner portion of the deck member, and a dowel 63 extends normally from the deck member to be received in an opening 64 in the flange, the opening being shown only in FIG. 4. The dowel is a short tube 57 secured to the deck member with a blind rivet 58, but alternative dowels can be devised. The remaining longitudinal members have similar dowels extending inwardly into the kayak to engage complementary undesignated openings in seats of the formers adjacent the respective members. Each recess is similar to the recess 61 and the former 39 is similar, and can be interchangeable with, the former 38. Each former is thus located between the longitudinal members by resilience in the longitudinal members forcing the dowels into respective openings in the flanges, thus locating the formers longitudinally and laterally relative to the longitudinal members. Other means of releasably interconnecting the formers to the longitudinal members can be devised.

The former 38 has a pair of similar inner lightening openings 67 and 68 defined by inner flanges 69 and 70, adjacent portions of which define an inner stiffening post 71 extending between upper and lower margins of the former. The post has an opening 72 to receive a captive wing nut, not shown, when the former is used in the backpack frame configuration of FIGS. 14–16. As is common practice, portions of the former extending between adjacent longitudinal members are curved inwardly as shown to provide clearance between the skin and the former, thus reducing damage to the skin when the skin is forced inwardly by an object against the framework. The former 38 has similar, generally parallel recesses 65 and 66 positioned between seats for the gunwale and chine member portions and extending upwardly from the outer flange. The recesses have a width sufficient to accept a wind nut assembly and are used when the former is used in the backpack frame. Whilst the formers 38 and 39 can be essentially identical, the former 39 does not need an opening equivalent to the opening 72 for the captive wing nut assembly, but instead requires a slot 73 for accepting the captive nut in the opening 72. The slot 73 is shown in broken outline in FIG. 2 to represent its position on the frame 39 adjacent the seat for the aft keelson member portion 20. The slot 73 can accept the dowel of the portion 20 when assembled in the kayak, and its further use in the backpack frame with the wing nut assembly in the opening 72 will be apparent from the description of FIG. 15.

FIGS. 2 and 5

The skin has deck portions having forward and aft longitudinal slits extending from a cockpit opening, which opening is shown only in FIG. 12 and is designated 178. A forward longitudinal slit 75 is defined by and has adjacent skin edges 76 and 77 which can be secured together by a forward zip fastener 74. The slit 75 is displaced to one side of the longitudinal deck member 35, which is adjacent the central area of the deck portion, and thus the slit is clear of the adjacent member 35. A backing strip 79 of skin material is secured adjacent the edge 76, which is the outermost edge of the slit, and is disposed generally parallel to the zip fastener 74. When edges of the skin are secured together, the strip 79 extends from a position adjacent the edge 76 across and beneath the zip fastener 74 to a free edge 80 thereof, an intermediate portion of the strip being sandwiched between the deck member 35 and a portion of the skin 12 passing over the deck member. Thus, a pocket 81 is formed between the skin and the backing strip to obstruct water passing through the zip fastener. It can be seen that sandwiching the intermediate portion of the backing strip produces a join between portions of the skin which resists penetration of water with a simple structure which can be easily assembled.

Thus the zip fastener cooperating with the skin edges to draw and secure the edges together, together with the backing strip, serve as a releasable fastening means adjacent the skin edges for closing the slit to resist penetration of water. The aft longitudinal slit is similar, and other means to secure and seal the edges together can be devised.

FIG. 6

The joint 44 between the tubular sections 42 and 43 of the forward keelson portion 19 is to be described in detail. This joint represents a typical joint between adjacent sections of the longitudinal members of the framework, and also between some of the mid portions of the cockpit structure and forward and aft portions of the longitudinal members. A forward end of the section 43 has a short length of inner tube 87 fitted therein, which tube has an outer diameter complementary to an inner diameter of the section 42 so that when the section 42 is fitted over the tube 87, the sections 42 and 43 are aligned and form a smooth joint.

Thus the tube 87 serves as a male portion for the section 43 and an adjacent end of the section 42 serves as a female portion to receive the male portion therein so as to maintain the longitudinal members in alignment. A plug 88 is fitted inwardly of an end of the section 42, and a similar plug, not shown, is fitted similarly adjacent the opposite end of the section 42 so as to seal ends of the tubes against water penetration to produce a floatation chamber within the tube. A similar plug 89 is fitted adjacent the end of the section 43, an opposite end of the tube, not shown, being similarly plugged. All the lengths of tubing are similarly plugged to provide floatation for the kayak framework.

A flexible tension link 90 extends between adjacent ends of the sections 42 and 43, that is between adjacent sections of the longitudinal members so as to draw the members together when the male portion is inserted into the female portion. The link has sufficient length to permit separation of the members so that when separated, one member can be laid alongside the adjacent member, as will be described. Anchoring rivets 92 and 93 are fitted adjacent ends of the sections 42 and 43 respectively so as to be between ends of the sections and the respective plugs so as to maintain floatation within the tube. The flexible tension link includes a tension coil spring 94 and a short length of chain 95 connected together so as to extend between the rivets, the spring having sufficient strength merely to maintain the tubes in alignment and yet permit easy separation. The chain has sufficient length to be folded around ends of the tube, thus preventing damage to the spring that would otherwise occur if the spring were folded about the tube end. Thus, the flexible tension link extends between plugs adjacent ends of adjacent members, and also between mid portions of the cockpit structure and adjacent longitudinal members so that each longitudinal member, with the exception of the longitudinal deck members, has tube sections connected together and also to the cockpit structure to form one element extending between between the bow and stern.

Alternative means to permit folding of the longitudinal members and to maintain the longitudinal members and cockpit structure together can be devised. The longitudinal members can be separated into more sections for shorter folded lengths, and a length of shock cord can extend inside the longitudinal members to connect them together, but this might eliminate some of the floatation chambers within the tube sections.

Figure 7:
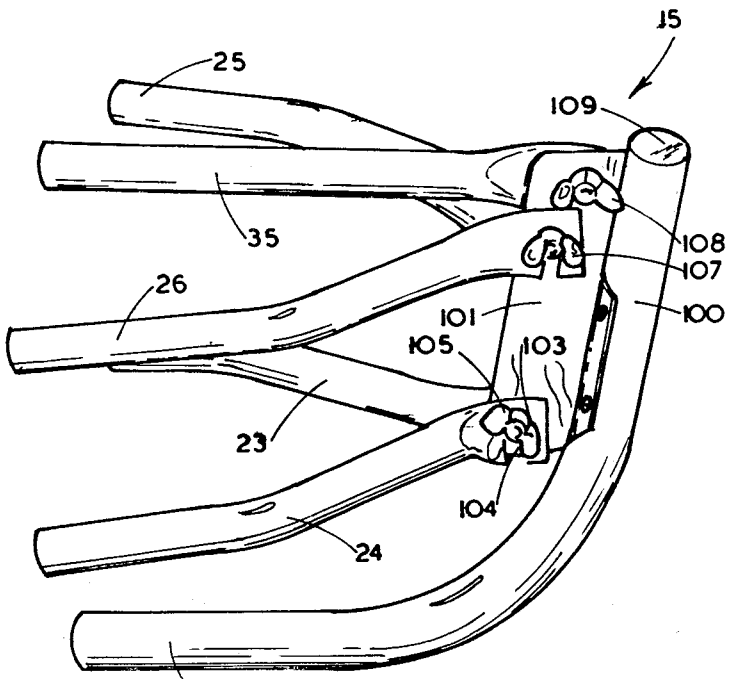
FIG. 7 is a simplified fragmented perspective of a bow portion of the kayak, the skin being removed.
Figure 8:
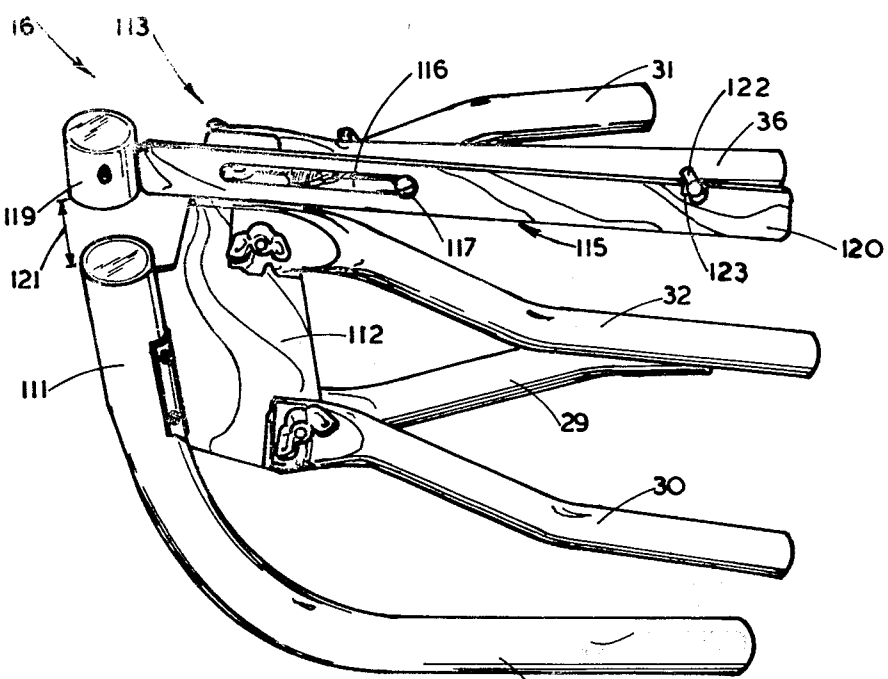
FIG. 8 is a simplified fragmented perspective of a stern portion of the kayak showing skin tautening means, the skin being removed.

FIGS. 7 and 8

In FIG. 7, the forward keelson portion 19 extends upwardly and forwardly at the bow to form a bow post 100 integral therewith, the bow post carrying an inwardly projecting bow flange 101 which, as can be seen, connects adjacent ends of the forward chine member portions, the gunwale member portions and the longitudinal deck member as follows. The forward starboard chine portion 24 is a tube with a flattened end 103 displaced laterally and having a downwardly facing slot 104. The forward port chine portion 23 has a similar flattened end, not shown, with a similar slot, not shown, and a wing nut assembly 105 passes through an opening, not shown, in the bow flange 101 to releasably secure forward ends of both the chine portions to the bow. The wing nut assembly 105 is captive, ie. it has a screw with means to prevent the wing nut from being completely disconnected from the screw thereof, and by merely loosening the wing nut the slots allow the chine portions to be quickly disconnected. The forward gunwale portions 25 and 26 and longitudinal deck members 35 are similarly releasably connected with respective wing nut assemblies 107 and 108 respectively. An upper portion of the bow post 100 has a plug 109 to seal the forward keelson portion 19 to maintain floatation in the portion 19.

Referring to FIG. 8, the aft keelson portion 20 extends upwardly and rearwardly to form a stern post 111 integral therewith similarly to the bow post 100 of FIG. 7, the post 111 carrying an inwardly extending stern flange 112 to which aft ends of the aft chine member portions 29 and 30, aft gunwale member portions 31 and 32 and aft longitudinal deck member 36 are secured in a manner similar to the structure shown in FIG. 7.

The stern differs from the bow mainly in the provision of a skin tautening means 113 which includes a manually actuated lever 115 having an elongated slot 116 which slot accepts a bolt assembly 117 adjacent an outer end of the aft longitudinal deck member 36. The slot 116 permits axial sliding of the lever and also rotation of the lever about the bolt assembly 117. Thus the slot and assembly 117 mounts the lever for movement within a generally vertical plane. The lever 115 has at an outer end thereof a stern extension means 119 which is a short cylindrical member which can be spaced from and generally aligned with an upper end of the stern post 111 so as to form a generally smooth continuation thereof separated by a gap 121. The gap 121 represents the downwards travel of the stern piece 119 as the lever 115 swings counter-clockwise, as viewed in FIG. 8, about the hinge of the bolt assembly 117. As will be described, to facilitate insertion of the stern into a stern pocket of the skin, not shown, the lever 115 can be moved forward and swung to close the gap 121. The lever has an inner end 120 adapted for manually applying a downwards force to tauten the skin when inserted in the stern pocket. A stop pin 122 extends laterally from the deck member 36 and can be engaged in a complementary recess 123 adjacent the inner end 120. When the pin 122 is engaged in the recess 123, the stern extension means 119 is located in an extended position as shown, thus tending to tauten the skin, and is prevented from moving axially or rotating by the skin and by the pin 122. Other location means to locate the extension means in the extended position aligned with the stern post and the longitudinal deck member can be devised. FIG. 8 illustrates the arrangement of components at the stern when the skin is fully installed and the extension means is located at a maximum practical distance from the end of the stern post. It can be seen that when fitted in a pocket of the skin generally complementary to the end of the framework, pushing the lever towards the stern and swinging the lever tautens the skin upwardly and away from the keelson member portion. The skin tautening means is preferably located at the stern as opposed to the bow to reduce likelihood of water penetrating gaps in the skin.

Figures 9, 10:
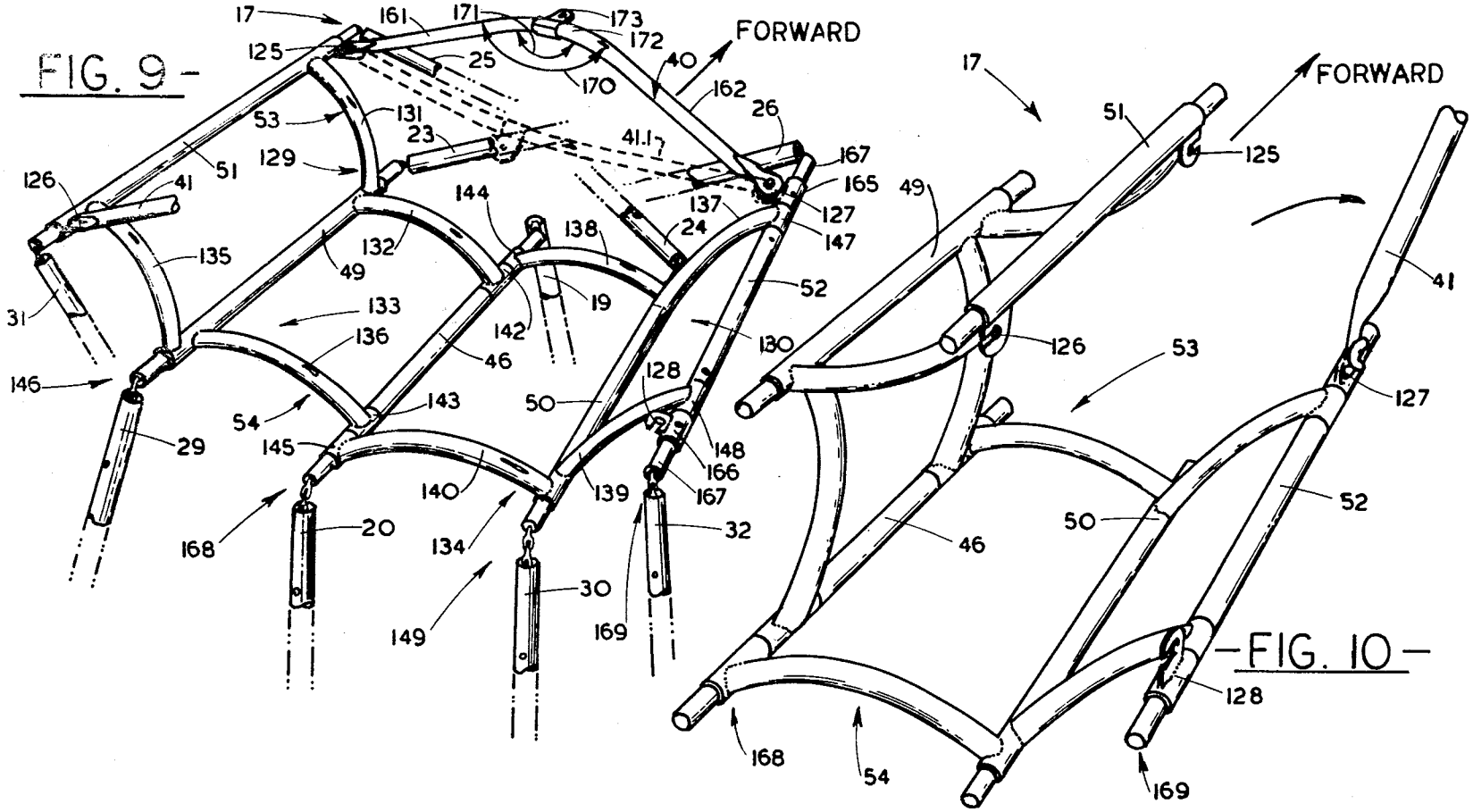
FIG. 9 is a simplified fragmented perspective of portions of a cockpit structure amidships of the kayak, the kayak being partially dismantled with the skin and seat removed.
FIG. 10 is a simplified fragmented perspective of portions of the cockpit structure of FIG. 9 during folding of the structure, FIG. 11 which appears on sheet 2 of the drawings, is a simplified fragmented longitudinal section through a short length of a keelson member mid portion showing a hinge structure.

FIGS. 9 through 11, with references to FIGS. 2, 6 and 16

As previously stated, the cockpit structure 17 includes a keelson member mid portion 46, port and starboard chine member mid portions 49 and 50 spaced on opposite sides of the keelson mid portion, and port and starboard gunwale member mid portions 51 and 52 spaced above the chine member mid portions 49 and 50. The forward and aft interconnecting members 53 and 54 interconnect adjacent mid portions so as to form a frame of generally parallel mid portions as shown which is as the cockpit structure 17 appears during assembly or disassembly of the framework. The port gunwale member mid portion 51 has inwardly extending forward and aft brackets 125 and 126, and the starboard gunwale member mid portion 52 has similar forward and aft brackets 127 and 128. The transverse deck members 40 and 41 have flattened ends with openings to receive captive wing nut assemblies, not shown, and the brackets 125 through 128 have slots so that the deck members can be releasably connected to the appropriate brackets on the gunwale member mid portions. In FIG. 9 only, adjacent ends of portions of longitudinal members are shown disconnected during collapsing of the framework 11.

The forward interconnecting member 53 has forward port and starboard interconnecting portions 129 and 130 which cooperate with the mid portions as follows. The portion 129 has a forward upper interconnecting member 131 extending between the gunwale member mid portion 51 and the chine member mid portion 49, and a forward lower interconnecting member 132 extending between the chine member mid portion 49 and the keelson member mid portion 46. The aft interconnecting member 54 has similar port and starboard portions 133 and 134, the port portion 133 having similar aft upper and lower interconnecting members 135 and 136 corresponding to the members 131 and 132 respectively. The forward starboard interconnecting portion 130 has forward upper and lower interconnecting members 137 and 138, and the aft starboard interconnecting portion 134 has aft upper and lower interconnecting members 139 and 140. Upper and lower ends of the interconnecting members 131 and 135 are rigidly connected, suitably by welding, to the gunwale and chine member mid portions 51 and 49 respectively, and are curved inwardly as shown to form a rigid, partially cylindrical, open space frame. The interconnecting members 132 and 136 extend from upper ends secured rigidly to the chine member mid portion 49 to short tube portions 142 and 143 cooperating with the keelson member mid portion 46, as will be described in detail with reference to FIG. 11. Similarly, the interconnecting members 138 and 140 have upper ends rigidly extending from the chine member mid portion 50 and lower ends secured to similar short tube portions 144 and 145 similarly cooperating with the keelson member mid portion. This results in the lower interconnecting members being staggered axially along the keelson member mid portion.

The upper interconnecting members 137 and 139 have lower ends rigidly extending from the chine member mid portion 50 and upper ends secured to short tube portions 147 and 148 cooperating with the gunwale member mid portion 52 in a manner similar to the keelson member mid portion. Thus, it can be seen that the forward and aft interconnecting members 53 and 54 each have respective port and starboard portions which, with the port and starboard chine and gunwale member mid portions, form rigid port and starboard cockpit frame halves 146 and 149 which both include the keelson member mid portion 46 and are not identical in structural detail but are generally symmetrical about the keelson member mid portion. Thus each interconnecting member has a respective port and starboard portion which is connected permanently and rigidly to the respective port and starboard chine and gunwale member mid portions. When the cockpit halves are interconnected with the transverse deck members, a rigid cockpit structure is formed from which the remainder of the framework can be built, in which the mid portions of the cockpit structure interconnect longitudinally the respective forward and aft longitudinal members.

Referring to FIG. 11 on sheet 2 of the drawings, an aft portion of the keelson member mid portion 46 will be described in detail to show cooperation between the portion 46 and the inner ends of the aft interconnecting portion and the aft keelson member portion 20. The tubes forming the keelson member mid portion 46, the aft keelson portion 20 and the short tube portions 143 and 145 have equal inner diameters. An inner tube 150 having an outer diameter complementary to the inner diameters fits through the tubes and the tube portions 143 and 145 are fitted between ends of the portions 20 and 46. A plug 151 seals an aft end of the keelson member 46 forward of an end of the inner tube 150 and a plug 154 seals a forward end of the aft keelson portion 20. A rivet 152 secures the aft end of the keelson mid portion 46 to the inner tube 150 and a rivet 153 secures the short tube portion 145 to the tube 150, thus sandwiching the tube portion 143 therebetween with sufficient clearance to permit free swinging of the tube portion 143 about the inner tube 150. A flexible link 156, similar to the link 90 of FIG. 6, extends between the rivet 152 and a similar rivet 158 passing through an adjacent forward end of the aft keelson portion 20, forward of the plug 154.

It can be seen that the aft lower interconnecting member portion 136 is effectively hinged on the keelson member mid portion, and the forward lower interconnecting member 132 is similarly journalled on the keelson member mid portion. Thus, it can be seen that journalling the lower interconnecting member portions 132 and 136 on the inner tube 150 effectively hinges the port cockpit half 146 on the keelson member mid portion. After the disconnection of the transverse deck members 40 and 41, the two cockpit halves 146 and 149 are effectively freely hinged to the keelson member mid portion and this hinging permits swinging of the port and starboard cockpit frame halves relative to each other. Thus, the lower interconnecting members have inner ends hinged to the keelson member mid portion for swinging of the cockpit halves thereabouts so that the cockpit structure can assume a variety of folded positions, one intermediate folded position being shown in FIG. 10. A fully folded diagrammatic representation of the cockpit structure is shown in FIG. 16, as will be described.

Referring again to FIG. 9, the starboard gunwale member mid portion 52 cooperates with the upper ends of the forward and aft upper interconnecting members 137 and 139 similarly to the cooperation of the lower members 132 and 136 with the keelson member mid portion 46, so as to permit rotation of the forward and aft brackets 127 and 128, for reasons as will be described. The brackets 127 and 128 extend from short tube portions 165 and 166 secured to an inner tube 167 which serves as a hinge pin, ends only of which are shown. Partial rotation of the brackets 127 and 128 is shown in FIG. 10.

Thus, it can be seen that there are two main hinges associated with the cockpit structure, namely a keelson hinge means 168 permitting hinging of interconnecting portions about the keelson member mid portion 46, and a gunwale hinge means 169 permitting hinging of the forward and aft brackets 127 and 128 about the starboard gunwale member portion 52. Equivalent means of permitting hinging of the cockpit frame halves relative to the portion 46, and rotation of the brackets 127 and 128 or the members 40 and 41 about the portions 51 or 52 can be devised. The hinge means 168 is means cooperating with the interconnecting members to permit the port and starboard mid portions to approach each other.

Referring again to FIG. 9, the forward transverse deck member 40 has port and starboard portions 161 and 162 inclined to each other in horizontal and vertical planes so as to resemble a generally shallow inverted V. When viewed in top plan, the portions are inclined to each other within a horizontal plane at an angle 170 of between approximately 150 and 165 degrees. When viewed in a vertical plane normal to the longitudinal axis of the kayak the portions are inclined to each other at an angle 171 of between approximately 120 and 145 degrees. The portions 161 and 162 converge to a radiused apex 172, and a simple C-shaped deck member bracket and wing nut assembly 173 is slidably fitted on the apex and, when in the kayak configuration can be releasably connected to the forward longitudinal deck member 35, using captive wing nut assembly means, not shown. Thus it can be seen that the apex of the forward deck member 40 is inclined forwardly away from the cockpit opening to increase clearance for a person entering or leaving the cockpit.

The aft transverse deck member 41 is not shown completely but is shaped similarly to the forward member 40 so that the two transverse deck members are essentially indentical and are thus interchangeable. The member 41 extends between the aft brackets 126 and 128 and has an apex inclined aftwards from the cockpit structure. A deck member bracket and wing nut assembly 174, similar to the assembly 173, is fitted to the apex of the aft member 41 and releasably connects the aft deck member 36 and is shown only in FIGS. 13 and 15. Shape of the deck members is critical to operation of the invention both as a kayak and as a backpack frame when carrying the kayak folded, as will be further described with reference to FIGS. 12 through 15. The transverse deck members are interchanged with each other when forming the backpack frame and the aft member 41 only is shown in broken outline at 41.1 in FIG. 9 in the forward position.

FIGS. 12 through 16, with references to FIGS. 2, 9 and 18.

Referring to FIG. 12, the skin 12 is shown partially removed from the bow 15 of the kayak. The forward longitudinal deck member 35, the forward former 38 and the forward transverse deck member 40 are shown partially covered by port and starboard bow skin portions 181 and 182 which have the adjacent edges 76 and 77 of the slit 75 joined by the zip fastener 74. As previously described, the zip fastener 74 is disposed slightly to the port side of the deck member 35 so that the backing strip 79 can be sandwiched between the starboard bow skin portion 182 and the member 35.

The cockpit opening 178 of the skin has forward panel edges 180 that pass over the forward transverse deck member 40, port and starboard panels 183 and 184 which have adjacent edges provided with releasable fastening means severally 186, such as nylon hook tape sold under the name "Velcro", a trade mark of Canadian Velcro Ltd. The skin has stern port and stern starboard skin portions 189 and 190 similarly secured together at skin edges 191 and 192 respectively with a zip fastener 193. A stern panel 195 of the skin is similarly provided with the fastening means 186, which in combination with the other panels, forms an upwardly extending sleeve to enclose the kayakist's body to essentially prevent penetration of water through the cockpit cover, similarly to a conventional detachable spray cover as used on a rigid kayak. If desired, to reduce wear, reinforcing patches and/or resilient pads, not shown, can be secured on the inner surface of the skin at locations where the skin contacts the frame. A fabric sling seat 200 is fitted to hang from the gunwale member mid portions 51 and 52, as best seen in FIG. 13.

Referring to FIG. 13, after complete removal of the skin, the kayak framework 11 is further dismantled by disconnecting the transverse deck members 40 and 41, removing the forward and aft formers 38 and 39, not shown, by forcing the longitudinal members outwardly from the formers, and disconnecting the longitudinal bow portions from the bow post 100. Two additional transverse deck member brackets and wing nut assemblies 204 and 205, similar to the assemblies 173 and 174, are slidably fitted on the deck member 40 and 41 and are used only in the backpack frame configuration, as will be described, but can remain on the deck members when used in the kayak configuration. The forward keelson member portion 19 is shown hinged at the joint 44, the forward port and starboard chine member portions 23 and 24 are shown hinged at joints 207 and 208 respectively, and the forward port and starboard gunwale member portions 25 and 26 are shown hinged at joints 209 and 210 respectively. The joints in effect divide each longitudinal portion into two lengths which are approximately equal and for convenience are termed "halves".

To dismantle the kayak further, the stern portion is disconnected similarly to the bow portion and the cockpit structure can then be folded similarly to the partially collapsed configuration shown in FIG. 10. From this configuration the forward and aft longitudinal members are then folded so that halves of each portion lie adjacent each other, as seen in FIG. 14. The folded together halves of the longitudinal portions are bundled to form separate first and second bundles 213 and 214, the first bundle including the forward longitudinal portions and the second bundle including the aft longitudinal portions. The longitudinal members are thus folded so that bow and stern portions are positioned on the opposite ends of the cockpit structure, so as to form two spaced generally parallel bundles of longitudinal members 213 and 214 sandwiching the folded cockpit structure therebetween. Elastic straps 215 are fitted around each bundle and also around the adjacent port gunwale member only so as to tie the bundles upright to a portion of the backpack frame.

The transverse deck members can be interchanged at this time or at a convenient earlier stage. When interchanged, the member 40 normally on the forward bracket 127 is fitted on the aft bracket 128, and the member 41, normally on the aft bracket 128 fits on the forward bracket 127 without altering the altitude of the transverse deck members relative to the gunwale member mid portions. Thus the member 41 is attached to the bracket 127 only so that the apex thereof is inclined towards the stern as shown in broken outline at 41.1 in FIG. 9, and shown in part in full outline in FIG. 10. In FIG. 14, the seat 200 has been removed and the transverse deck members 40 and 41 are shown interchanged from the kayak positions and extending downwardly in a similar direction from the starboard gunwale member mid portion 52.

Referring to FIGS. 14 and 15, the forward former 38 is fitted to extend between upper portions of the deck members 40 and 41 adjacent the chine member mid portion 50 and is secured thereto by wing nut assemblies on the deck member brackets 173 and 174. The brackets 173 and 174 are slid along the deck members to a required spacing so that the wing nut assemblies are accepted in the respective recesses 65 and 66 in the former 38, best seen in FIG. 2, to secure the former to the deck member.

The aft former 39 is also secured to the deck members 40 and 41 by the wing nut and bracket assemblies 204 and 205 which are slid along the deck members 40 and 41 to appropriate locations below the assemblies 173 and 174. The assemblies 204 and 205 have screws which are received in the respective recesses in the former 39 similarly to the former 38. A wing nut assembly 224 in the opening 72 of the former 38 is received in the slot 73, FIG. 2 only, in the former 39 to secure the formers together, thus further stiffening the assembly. Thus the formers are on the same sides of the members 40 and 41 as the cockpit structure 17.

A band 216 extends between the deck members 40 and 41 and has a pair of generally parallel sleeves 217 and 218 sewn at opposite ends thereof, the sleeves having a diameter sufficient to accept ends of the transverse deck members threaded therethrough. Openings in the sleeves accept wing nut assemblies 202 and 203 to prevent the band being moved along the members, which assemblies are normally used to secure the members 40 and 41 to the brackets 125 and 126 on the gunwale member mid portion 51.

As seen in FIGS. 15 and 16, a transverse strap 219 extends parallel to the gunwale members and between upper ends of the transverse deck members 40 and 41 and is secured thereto with wing nut assemblies 211 and 212 also used to secure the deck members to brackets on the gunwale member mid portion 52. The strap 219 carries a pair of padded shoulder straps 220 and 221 which have respective lower ends secured to lower ends of the transverse deck members 40 and 41, also using wing nut assemblies 202 and 203.

Thus it can be seen that the bracket assemblies 173 and 174 serve two purposes, namely securing the longitudinal deck members to the transverse deck members when in the kayak configuration, and securing the former 38 to the transverse deck members when in the backpack configuration. The formers 38 and 39 maintain the transverse deck members apart, and the band 216 has a length just sufficient to extend between ends of the deck members 40 and 41 to be taut.

In FIG. 14, the cockpit structure is shown fully folded, ie. the mid portions 51 and 52 almost touching each other, and thus has relatively limited capacity for storage of gear for carrying on a person's back. If properly folded a lightweight kayak skin can be fitted within the cockpit structure folded as shown. In FIG. 16, the cockpit structure is shown partially folded in full outline in which the gunwale mid portions 51 and 52 are shown separated by a spacing 222 which is wide enough to accept additional gear. In FIG. 16, the port half of the cockpit structure is shown in broken outline in the fully folded position in which the port gunwale and port chine member mid portions 51.1 and 49.1 are shown closer to the starboard gunwale and chine member mid portions 52 and 50, thus reducing available volume within the cockpit structure for gear storage. Additional gear, such as tent, sleeping bag, etc. can be secured directly to other portions of the backpack frame structure similarly to a conventional backpack frame. It can be seen that inward curvature of the lower interconnecting members 132, 136, 138 and 140 would cause interference with each other except for the axial staggering of the interconnecting members on the keelson member mid portion 46 as seen in FIGS. 9 and 10.

As best seen in FIG. 16, the starboard chine mid portion 50 can be seen to interfere with the former 38 at a position generally adjacent an approximate mid portion of an upper half of each of the deck members 40 and 41. The members 40 and 41 are inclined relative to the band 216 to hold the folded cockpit structure and the two formers 38 and 39, shown without attachments, away from the back of the wearer so as to eliminate uncomfortable interference with the wearer. The shallow V of the deck members is thus preferred and the angle 171 of the V is critical to avoid interference as above. If the angle is too shallow, the formers 38 and 39 may be too close to the wearer's back, and the wing nut assemblies holding the formers together and on the members 40 and 41 may be too close to the wearer's back and cause painful interference as described above. If the angle is too steep, the cockpit structure is forced excessively upwards so as to cause the bundles of longitudinal deck members to be inclined upwardly and forwardly which may tend to project forwardly past the wearer's head over his shoulders thus restricting visibility. If positions of the joints of the longitudinal deck member are correctly selected, a practical unit is formed in which the deck members extend a short distance above shoulders of the wearer and a short distance below the hips and thus is suitable for carrying on the trail. The longitudinal members are shown in broken line as the bundle 214 and it can be seen that as that spacing 222 becomes wider, the longitudinal members are forced into a wider fan which becomes unpractical in some widths. If desired the longitudinal members can be made to be separated from the cockpit structure to permit easier folding into more compact bundles, and, whilst this results in more separated components that might be lost, greater flexibility of design and carrying methods are attained.

The formers 38 and 39 are secured to the upper and lower portions of the deck members and serve as means to stiffen the backpack frame so as to maintain the transverse deck members apart to apply tension to the band 216. Other means to maintain the deck members apart can be devised and the formers can be carried elsewhere, but, as can be seen in FIG. 16, location of the formers relative to mid position of the transverse deck members is fairly critical to avoid interference with the wearer's back. The formers are disposed generally coplanar with planes containing upper and lower portions of the deck members so as to be clear of the wearer's back. It can be seen that there is little clearance between the deck members and the wearer's back and thus some adjustment of the position of the formers may be necessary depending on the size of the person. In most cases, both formers are necessary to stiffen the backpack frame to provide a framework sufficiently stiff to transfer some weight to the wearer's hips, and, if desired, a hip belt, not shown, can be substituted for the band 216.

OPERATION

Referring primarily to FIGS. 12 through 16, it can be seen that the kayak can be converted into a backpack frame by a method characterized by the following steps. The kayak framework is removed from the skin by unzipping the zip fasteners 74 and 193 at the bow and stern panels respectively which, after releasing the skin tautening lever 115, FIG. 8 only, from the stern permits removal of the kayak frame from the skin. The formers can be quickly released by springing the longitudinal members apart which withdraws the dowels which extend inwardly from the longitudinal members from out of the openings in the flanges of the formers. The longitudinal members are disconnected from the bow and stern posts by loosening wing nut assemblies at appropriate locations, and swinging the longitudinal members away from the posts.

The transverse deck members are then disconnected from the port gunwale member mid portion 51 and rotated outwardly about the starboard gunwale member mid portion 52 simultaneously as the cockpit structure is folded inwardly bringing the gunwale member mid portions towards each other. The positions of the transverse deck members are then interchanged so as to extend from the gunwale member mid portion 52 to be generally parallel to each other. Each longitudinal member, either the bow or stern portion thereof, is separated at its respective joints so that it can be folded back on itself and placed adjacent similarly folded longitudinal members so as to form the respective bundles on opposite sides of the folded structure. Thus the longitudinal members extending from the cockpit structure to the bow are gathered into the first bundle 213 and the longitudinal members extending from the cockpit structure to the stern are gathered into the second bundle 214. The first and second bundles are secured adjacent forward and aft ends of the folded cockpit structure, the elastic straps 215 being a simple and quick means of retaining the folded deck members in bundles.

The band 216 is fitted between the lower ends of the transverse deck members and is adapted to engage a wearer's torso. The bracket and wing nut assemblies 173, 174, 204 and 205 are slid upwardly away from the apex of the deck members to positions such that wing nut assemblies of the brackets on the formers do not project into the wearer's back. The formers 38 and 39 are fitted to the assemblies 173 and 174, and 204 and 205 respectively to extend between the transverse deck members so as to force the deck members apart to maintain the band 216 taut. The transverse strap 219 is fitted to extend tautly between the brackets 127 and 128, and the wing nut assemblies 202 and 203 adjacent the lower ends of the transverse deck members secure the lower ends of the pair of shoulder straps 220 and 221 to form two loops to be carried on a person's shoulders and simultaneously locate the band 216 at the ends of the transverse deck members. The structure thus resembles a backpack frame structure in which the mid portions of the cockpit structure extend generally normally to the transverse deck members and are disposed on a side of the deck member remote from the back of the wearer.

In summary, it can be seen that a major aspect of this structure is that the transverse deck members have a critical shallow V-shape or curved shape so as to hold the folded cockpit structure away from the wearer's back. The shape of the transverse deck members as described is such that the transverse deck members must be disconnected from the cockpit structure and then repositioned. Thus each transverse deck member has an upper end connected to a particular gunwale mid portion, in this case the starboard portion 52, with one former secured to an upper half of each transverse deck member to interfere with the cockpit structure to maintain the cockpit structure away from the back of the wearer. A lower portion of each transverse back member extends downwardly and then towards the back of the wearer and carries the band adjacent the lower end.

It may be that alternate structure to the transverse deck members can be devised that function similarly to the transverse deck members without requiring both ends of the transverse deck members to be releasably connected to the gunwale member mid portions as in the present structure. By suitable selection of size and spacing of the cockpit structure, simple hinging of the adjacent ends of the transverse deck members to the appropriate gunwale member mid portion may provide a suitable backpack frame.

Dimensional Considerations

The disclosure relates to a single seat kayak of generally conventional touring kayak dimensions, which can be varied to suit particular needs. Ranges of dimensions of importance are listed below, and clearly limits of dimensions are based on an average adult and can be varied. The cockpit is displaced about twelve centimeters aft of mid length and thus the forward longitudinal members are longer than the aft longitudinal members, but this can be varied. Length of cockpit mid portions should not exceed those stated otherwise difficulty in carrying the structure through undergrowth is likely.

Overall length of kayak: 4.5 meters

Maximum beam, ie width across gunwale member mid portions: 63.5 cms.

Maximum height, ie. transverse member apex to keelson member mid portion: 34.0 cms.

Length of cockpit med portions (average-excluding dowels): 50.0 cms.

Angle 170 is 160 degrees.

Angle 171 is 135 degrees.

I claim:

1. A collapsible kayak having a framework characterized by a plurality of longitudinal members including forward and aft keelson member portions, forward and aft port and starboard chine and gunwale member portions, and forward and aft longitudinal deck members; formers and a cockpit structure, the longitudinal members releasably interconnecting the cockpit structure with the bow and stern of the kayak; the cockpit structure including:

(a) a keelson member mid portion, port and starboard chine member mid portions spaced on opposite sides of the keelson member mid portion, and port and starboard gunwale member mid portions spaced above the chine member mid portions, the mid portions interconnecting longitudinally the respective forward and aft longitudinal members, (b) forward and aft interconnecting members interconnecting adjacent member mid portions so as to form a frame of generally parallel mid portions, each interconnecting member having a respective port and starboard portion which is rigidly and non-hingedly fixed to the respective port and starboard chine and gunwale member mid portions to form rigid port and starboard cockpit frame halves, (c) the port and starboard cockpit frame havles being hinged relative to each other about the keelson member mid portion by at least one of said port and starboard portions of said interconnecting members being hinged to said keelson member mid portion to effectively permit the cockpit structure to be folded about the keelson member mid portion to permit the port and starboard mid portions to approach each other, (d) forward and aft transverse deck members adapted to extend between the gunwale member mid portions to define with the gunwale member mid portions a cockpit opening to receive a kayakist, each transverse deck member having at least one end releasably connected adjacent an opposite end of one of the gunwale member mid portions, the forward and aft longitudinal deck members being releasably connected to the forward and aft transverse deck members.

so that when the framework is assembled the forward and aft keelson, chine and gunwale member portions are connected to the respective keelson, chine and gunwale member mid portions of the cockpit structure to form a generally smoothly curved framework.

2. A collapsible kayak as claimed in claim 1 in which the cockpit structure is further characterized by:

(a) the transverse deck members resemble generally shallow inverted V's and have opposite ends releasably interconnected adjacent respective ends of the gunwale member mid portions.

3. A collapsible kayak as claimed in claim 1 in which the interconnecting members of each cockpit frame half is characterized by:

(a) forward and aft upper interconnecting members extending rigidly between the gunwale member mid portion and the chine member mid portion, (b) forward and aft lower interconnecting members extending rigidly from the chine member mid portion towards the keelson member mid portion, the lower interconnecting members of at least one cockpit frame half having inner ends hinged to the keelson member mid portion for swinging thereabout.

4. A collapsible kayak as claimed in claim 1, 2 or 3 in which:

(a) the forward and aft keelson portions extend to the bow and stern of the kayak to cooperate with upwardly extending bow and stern posts, (b) outer ends of the remaining longitudinal members are releasably connected to the bow and stern posts.

5. A collapsible kayak as claimed in claim 1 in which:

(a) each longitudinal member is formed of a plurality of aligned sections interconnected at adjacent ends with connecting means, the connecting means being characterized by:

(b) one end of a first section of a longitudinal member having a male portion, and an adjacent end of a second section of the longitudinal member having a complementary opening to serve as a female portion to receive the male portion therein so as to maintain the longitudinal members in alignment, (c) a resilient flexible link extending between the adjacent longitudinal members so as to draw the members together when the male portion is inserted in the female portion, and to permit separation of the members so that when separated, one member can be laid alongside the adjacent member.

6. A folding kayak as claimed in claim 5 further characterized by:

(a) the longitudinal members being tubes, (b) a plug fitted adjacent each end of each tube to seal ends of the tube against water penetration to produce a floatation chamber within the tube, (c) the male portion of the first longitudinal member being a tube having an outer diameter complementary to inner diameters of the tubes of the longitudinal members, so as to be accepted to form smooth joints between adjacent members.

7. A folding kayak as claimed in claim 5 or 6 in which:

(a) the flexible link includes a tension coil spring and a length of chain connected together so as to extend between plugs adjacent ends of adjacent members.

8. A collapsible kayak as claimed in claim 1 having:

a flexible water impermeable skin for covering the framework, the skin being complementary to the framework and having a cockpit opening therein, and forward and aft longitudinal slits extending from the cockpit opening along deck portions of the skin, the slits being defined by opposite skin edges, (b) releasable fastening means being provided adjacent the skin edges for closing the slits to resist penetration of water, so that when the framework is assembled it can be fitted through the cockpit opening and the longitudinal slits of the skin, after which the skin is fitted around the framework and the fastening means connected together along the decks to tauten the skin on the framework and to provide a cockpit opening in the skin coincident with the cockpit structure to receive the kayakist.

9. A collapsible kayak as claimed in claim 8 in which:

(a) the slits are displaced to one side of central areas of the respective deck portions so as to be clear of the adjacent longitudinal deck member, and the releasable fastening means for each slit is characterized by:

(b) a zip fastener cooperating with the skin edges to draw and secure the skin edges together, (c) a backing strip extending generally parallel to the zip fastener from a position adjacent an outermost skin edge of the slit, the backing strip being adapted to pass across and beneath the zip fastener and between the adjacent longitudinal deck member and the skin so that an intermediate portion of the backing strip is sandwiched between the longitudinal deck member and a portion of the skin passing over the deck member, so that when the adjacent edges of the skin are secured together the backing strip extends beneath the fastening means and a pocket is formed to obstruct water passing through the zip fastener.

10. A collapsible kayak as claimed in claim 9 further including a skin tautening means characterized by:

(a) a lever mounted adjacent an outer end of a longitudinal deck member for movement generally within a generally vertical plane, the lever having inner and outer ends, the inner end being adapted for applying tautening force thereto, the outer end having extension means which, in an extended position thereof, can be spaced from and generally aligned with a stern post of the kayak framework so as to form a generally smooth continuation thereof, (b) location means to locate the extension means in an extended position aligned with the stern post and the longitudinal deck member, the tautening means and stern being adapted to be fitted in a pocket of the kayak skin complementary to the end of the framework so that actuation of the lever tautens the skin.

11. A collapsible kayak as claimed in claim 1 in which the kayak, when disassembled, can form a backpack frame configuration, the kayak being further characterized by:

(a) the cockpit structure being foldable about an axis parallel to the mid portions thereof so as to bring the mid portions closer together, (b) the forward and aft transverse deck members each have port and starboard portions inclined to each other to resemble a generally shallow inverted V, the transverse deck members having adjacent ends connectable to one particular gunwale member mid portion so that, when the cockpit structure is folded into the backpack frame configuration, the gunwale member mid portions are disposed generally parallel and adjacent to each other adjacent an upper portion of the backpack frame, and the transverse deck members extend generally normally from positions adjacent ends of the particular gunwale member mid portion in a direction opposite to that when assembled in a cockpit structure, (c) means to maintain the transverse deck member apart, (d) a band extending between outer ends of the transverse deck members to be supported against a person's torso.

12. A collapsible kayak as claimed in claim 11 in which:

(a) the forward and aft keelson, chine and gunwale member portions are folded into two bundles of longitudinal members and means are provided to support the bundles disposed generally parallel to each other on opposite sides of the cockpit structure, so that when assembled to form the backpack, the folded cockpit structure is straddled by two bundles of longitudinal members of the kayak framework.

13. A method of folding a kayak into a framework suitable for use as a backpack frame, in which the kayak has: a skin and a plurality of longitudinal members including forward and aft keelson member portions, forward and aft port and starboard chine and gunwale member portions, and forward and aft longitudinal deck members; formers and a cockpit structure; the cockpit structure including a keelson member mid portion, port and starboard chine member mid portions and port and starboard gunwale member mid portions, forward and aft interconnecting members interconnecting the mid portions on each side of the cockpit structure to form rigid port and starboard cockpit halves hinged about the keelson member mid portion, forward and aft transverse deck members each having at least one end releasably connected adjacent opposite ends of one of the gunwale member mid portions for swinging thereabout, the method being characterized by:

(a) removing the kayak framework from the skin, (b) removing the formers and disconnecting the longitudinal members from each other, from the transverse deck members and from the mid portions of the cockpit structure, (c) folding the cockpit structure about the keelson member mid portion so as to bring the chine and gunwale member mid portions closer together, (d) securing the longitudinal members for easy carrying, (e) positioning the transverse deck members to extend from one side of the cockpit structure in a similar direction, (f) connecting a band to extend between the transverse deck members adapted to engage a wearer's torso and simultaneously maintaining the transverse deck members apart to maintain the band taut, (g) connecting a pair of shoulder straps to positions adjacent upper and lower ends of the transverse deck members so as to form two loops to engage a person's shoulders so as to resemble a backpack frame structure in which the mid portions of the cockpit structure extend generally normally to the transverse deck members and are disposed on a side of the deck members remote from the person's back.

14. A method as claimed in claim 13 in which the method of securing the longitudinal members for easy carrying is further characterized by:

(a) gathering the longitudinal members extending from the cockpit structure to the bow into a first bundle, and gathering the longitudinal members extending from the cockpit structure to the stern into a second bundle, (b) securing the bundles adjacent ends of the mid portions of the folded cockpit structure so that the cockpit structure is sandwiched between the bundles.

15. A method as claimed in claim 13 in which the transverse deck members are generally shallow V-shaped and the method is further characterized by:

(a) disconnecting the transverse deck members from the cockpit structure and repositioning them so that each transverse deck member has an upper end thereof connected to a particular gunwale member mid portion, with means secured to an upper half thereof interfering with the cockpit structure to hold the folded cockpit structure away from the back of the wearer, and a lower portion thereof extending towards the back of the wearer and carrying the band adjacent a lower end of the lower portion.

16. A method as claimed in claim 15 in which the method of maintaining the transverse deck members apart is further characterized by:

(a) releasably connecting a former between the transverse deck members to maintain the deck members apart, the former being disposed generally coplanar with a plane containing the deck members so as to interfere with the folded cockpit structure and to be clear of the wearer's back.

* * * * *